US008128199B2

(12) United States Patent
Osaki

(10) Patent No.: US 8,128,199 B2
(45) Date of Patent: Mar. 6, 2012

(54) INK JET PRINT HEAD, METHOD FOR MANUFACTURING INK JET PRINT HEAD, AND PRINTING APPARATUS

(75) Inventor: Yasuhiko Osaki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 987 days.

(21) Appl. No.: 12/061,510

(22) Filed: Apr. 2, 2008

(65) Prior Publication Data

US 2008/0291243 A1 Nov. 27, 2008

(30) Foreign Application Priority Data

Apr. 3, 2007 (JP) ..... 2007-097714
Mar. 21, 2008 (JP) ..... 2008-074020

(51) Int. Cl.
*B41J 2/15* (2006.01)

(52) U.S. Cl. ..... 347/40; 347/20; 347/41; 347/42; 347/43; 347/44; 347/45; 347/46; 347/47; 347/48; 347/68; 347/69; 347/70; 347/71; 347/72

(58) Field of Classification Search ..... 347/20, 347/40–48, 68–72
See application file for complete search history.

(56) References Cited

U.S. PATENT DOCUMENTS

| | | | | |
|---|---|---|---|---|
| 5,983,471 | A * | 11/1999 | Osawa | 29/25.35 |
| 5,992,974 | A * | 11/1999 | Miyata | 347/47 |
| 6,213,594 | B1 * | 4/2001 | Kitahara | 347/70 |
| 6,767,084 | B2 * | 7/2004 | Moriya et al. | 347/70 |
| 7,789,499 | B2 * | 9/2010 | Iwanaga et al. | 347/72 |
| 2006/0209141 | A1 * | 9/2006 | Kojima | 347/85 |
| 2007/0146440 | A1 * | 6/2007 | Kojima et al. | 347/68 |
| 2007/0242101 | A1 | 10/2007 | Hirosawa | |

FOREIGN PATENT DOCUMENTS

JP 2006-56243 3/2006

* cited by examiner

*Primary Examiner* — Ryan Lepisto
*Assistant Examiner* — Guy Anderson
(74) *Attorney, Agent, or Firm* — Canon USA Inc. IP Division

(57) ABSTRACT

An ink jet printing apparatus and an ink jet printing method which use a print head having a plurality of ejection port rows to enable high-quality printing without causing uneven density in a conveying direction by varying the printing distribution ratio of the ejection port rows in the print head depending on gray level.

9 Claims, 20 Drawing Sheets

INK JET PRINT HEAD, METHOD FOR MANUFACTURING INK JET PRINT HEAD, AND PRINTING APPARATUS

BACKGROUND OF THE INVENTION

1. Field of the Invention

The present invention relates to an ink jet print head that ejects ink or the like to a print medium, a method for manufacturing the ink jet print head, and a printing apparatus.

2. Description of the Related Art

Printing apparatuses using an ink jet printing system of ejecting ink to a print medium for printing have excellent characteristics. These printing apparatuses easily provide a high resolution image, operate silently at a high speed, and are inexpensive, as compared to printing apparatuses based on other systems. However, with the recent significant prevalence of personal computers, digital cameras, and the like, there has been a demand to stabilize the operation of ink jet printing apparatuses or ink jet print heads as image output instruments.

FIG. 15A is a schematic top view showing a conventional ink jet print head disclosed in, for example, Japanese Patent Laid-Open No. 2006-56243 (corresponding to US Patent Publication 2007-242101). FIG. 15B is a partial sectional view showing a part of a side surface of the ink jet print head in FIG. 15A. A flexible board 1502 is bonded to a support member 1504, and a board (hereinafter referred to as a liquid ejection board) 1501 having a plurality of fine nozzles for ink ejection is mounted on the flexible board 1502. The periphery of the liquid ejection board 1501 is sealed with a sealant 1503. The sealant 1503, for example, prevents a side surface of the liquid ejection board 1501 from possible contact with ink, prevents the possible corrosion by ink of lead terminals connecting the flexible board 1502 and the liquid ejection board 1501 together, or prevents the possible breakage of the lead terminals under an external force.

Ink jet printing apparatuses use characteristic print condition recovery means (hereinafter simply referred to as recovery means). With the ink jet printing apparatus, when ink is ejected from ejection ports, fine ink droplets (ink mists) may be generated and attach to an ejection opening array surface of the print head. In another case, dust such as paper dust may attach to the ejection opening array surface. The attachment may prevent ink from being appropriately ejected, hindering improvement of printing quality. Thus, as means for eliminating the causes of inappropriate ejection, recovery means is generally used which wipes the ejection opening array surface of the liquid ejection board using a wiping member made of an elastic material such as rubber (this operation is hereinafter referred to as wiping), to remove the ink droplets, dust, and the like.

Due to the generally small size of the liquid ejection board 1501, for wiping, a plurality of the liquid ejection boards 1501 are commonly wiped using one wiping member. However, during such wiping, ink is likely to collect in a recessed portion 1505 between the liquid ejection boards 1501.

FIG. 16 shows that ink 1601 has been collected in the recessed portion 1505 between the liquid ejection boards 1501. In this case, when a wiping operation is then performed to scrape the thus collected ink 1601 out of the recessed portion, the ink 1601 may disadvantageously stain the ejection port surface, preventing an appropriate printing operation. In another case, the collected ink may fall onto paper during printing.

On the other hand, even when only one liquid ejection board is used, the periphery of the liquid ejection board may be surrounded by a plate so as to prevent the projection of the liquid ejection board. Also in this case, if any recess is present between the board and the plate, ink is likely to be collected in the recess.

To prevent this phenomenon, the recess, in which ink may be collected, may be effectively filled with a sealant 1503 to flatten and seal the area between the liquid ejection boards 1501 or between the liquid ejection board and the plate.

However, if the sealant is filled into the recess to flatten the area of the recess, the following disadvantages may result.

FIGS. 17 and 18 show that internal stresses $\alpha$ and $\beta$ have been generated in the conventional ink jet print head by the sealant 1503. If the area between the liquid ejection boards 1501 is sealed so as to be flattened, a relatively large amount of sealant 1503 is used. The sealant 1503 selected to adhere well to a plurality of members unavoidably generates a high internal stress after curing or has a large coefficient of linear expansion. The sealant 1503 generating a high internal stress $\alpha$ or having a large coefficient of linear expansion may be expanded or contracted by a variation in temperature during a manufacturing process or in the temperature of an environment in which the product is used. In this case, the sealant 1503 may exert an external force on the liquid ejection board to break the liquid ejection board.

To prevent the possible breakage of the liquid ejection board 1501, the amount of sealant used to seal the periphery of the liquid ejection board 1501 may be reduced to the minimum required value. However, in order to flatten the area of the recess, in which ink may be collected, a relatively large amount of sealant 1503 unavoidably needs to be used as described above. This may disadvantageously result in damage to the liquid ejection board 1501.

If the area between the liquid ejection boards 1501 are sealed with the sealant 1503 so as to be flattened as shown in FIG. 18, the sealant 1503 may contact ink and swell during printing. In this case, the stress $\beta$ may also occur to peel the sealant 1503 off side surfaces of the liquid ejection boards 1501.

Further features of the present invention will become apparent from the following description of exemplary embodiments (with reference to the attached drawings).

SUMMARY OF THE INVENTION

The above-described problems are likely to occur particularly if the liquid ejection board 1501 has a very small thickness or an increased length. The present invention is directed to an ink jet print head that prevents, for example, the possible collection of ink between liquid ejection boards provided in a print head or between the liquid ejection board and the plate surrounding the periphery of the liquid ejection board, and possible damage to the liquid ejection board.

According to an aspect of the present invention, there is provided an ink jet print head comprising a liquid ejection board having an ejection port from which ink is ejected, the liquid ejection board comprising a first member comprising a surface where the ejection port is opened therein and a second member supporting the first member, a periphery of the liquid ejection board being sealed with a sealant. A side surface of the second member is sealed with the sealant, and a cavity is formed inside the sealant.

According to another aspect of the present invention, there is provided a method for manufacturing an ink jet print head. The method comprises forming a liquid ejection board using a first member having surface which is provided with the ejection port and a second member supporting the first member, sealing a periphery of the liquid ejection board with a sealant, the liquid ejection board ejecting ink for printing, sealing a side surface of the second member with the sealant, and forming a cavity of a preset size inside the sealant.

The present invention seals, with the sealant, the area between the liquid ejection boards in the print head or between the liquid ejection board and the plate surrounding the periphery of the liquid ejection board so as to seal the side surface of the support member partly forming the liquid ejection board. The cavity is formed inside the sealant. This provides an ink jet print head and a printing apparatus which prevent, for example, the possible collection of ink between the liquid ejection boards in the print head and possible damage to the liquid ejection board.

DESCRIPTION OF THE EMBODIMENTS

First Embodiment

A first embodiment of the present invention will be described below in detail with reference to the drawings.

Figure 1:
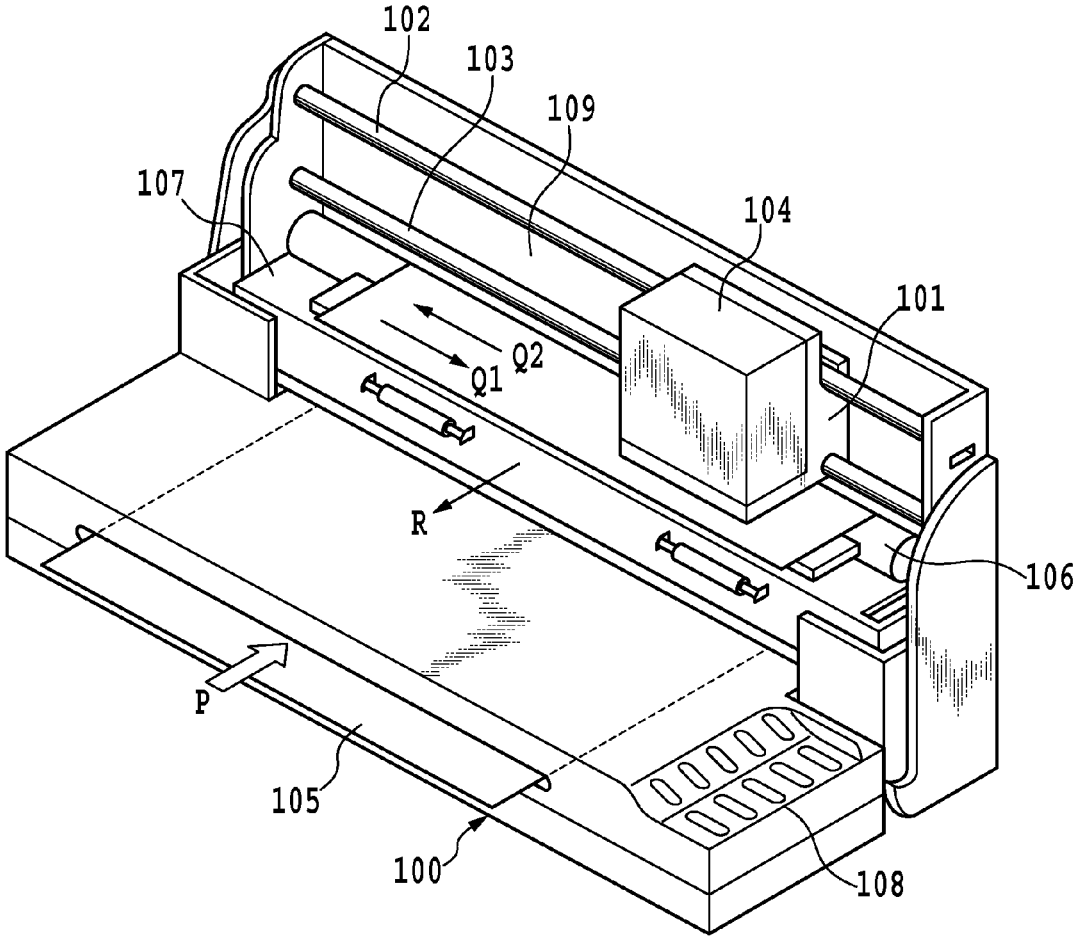
FIG. 1 is a perspective view showing an essential part of a printing apparatus to which the present invention is applicable.

FIG. 1 is a perspective view showing an essential part of a printing apparatus to which the present invention is applicable. For printing, a print medium 105 is inserted into a printing apparatus 100 in the direction of arrow P through a sheet feeding position. A direction in which the inserted print medium 105 is conveyed is subsequently reversed. The print medium 105 is then fed in the direction of arrow R, which corresponds to a sub-scanning direction, by a feeding roller 106. Then, in a printing area, the print medium 105 is printed by being subjected to main scanning by an ink jet cartridge 104. In the printing area, a platen 107 is located under the print medium 105 to hold the print medium 105 at the appropriate position. A carriage 101 on which the ink jet cartridge 104 can be mounted is held by two guide shafts 102 and 103. The carriage 101 performs scanning in a main scanning direction (the two directions of arrows Q1 and Q2) by means of a driving motor (not shown). A printing section of the printing apparatus allows a print head (not shown) in the ink jet cartridge 104 mounted on the carriage 101 to eject ink to the print medium 105, while alternately repeating the main scanning of the carriage 101 and the sub-scanning of the print medium 105.

Figure 2:
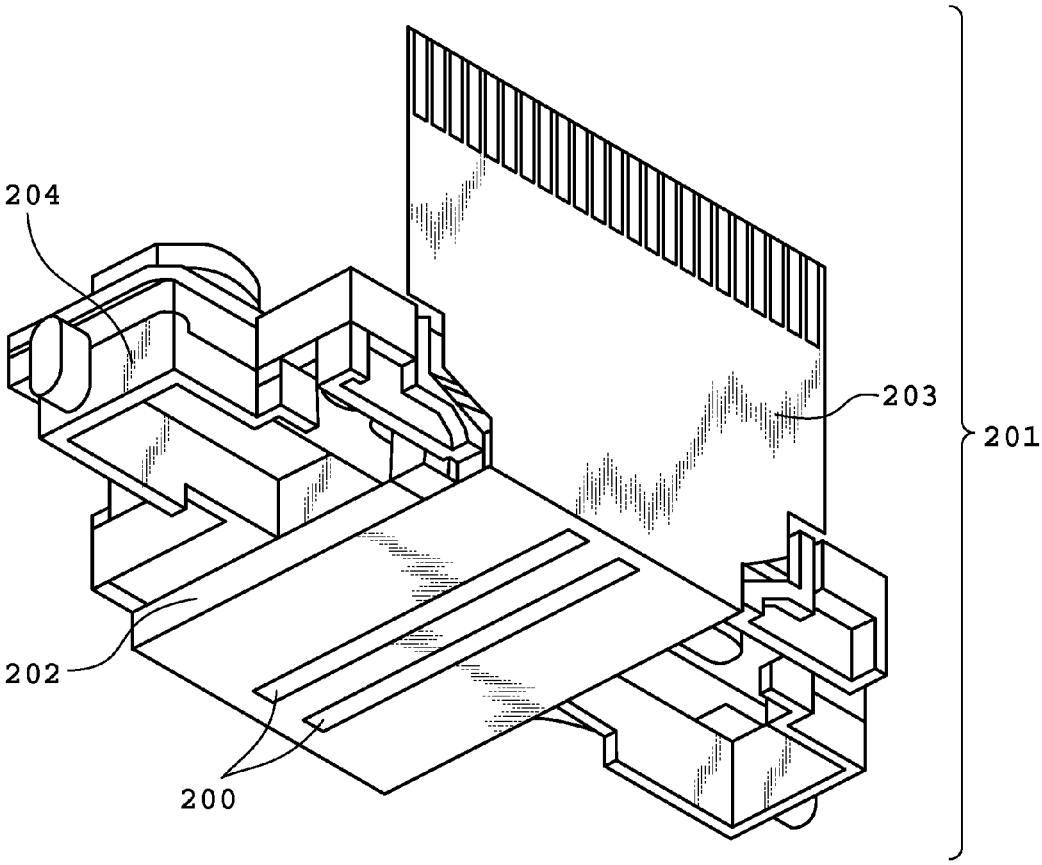
FIG. 2 is a schematic perspective diagram showing an ink jet print head according to a first embodiment.

FIG. 2 is a schematic perspective view showing an ink jet print head (hereinafter simply referred to as a print head) 201 according to the present embodiment. The print head 201 includes a liquid supply member 204 that supplies a liquid such as ink, a support member 202 having a liquid supply path described below and through which a liquid supplied by the liquid supply member 204 passes, and a flexible wiring board 203 having liquid supply holes described below. The print head 201 further includes a plurality of liquid ejection boards 200 provided on the flexible wiring board 203 so that the liquid supplied by the liquid supply member 204 can be ejected from the liquid ejection boards 200. The liquid supply member 204 includes a supply path (not shown) to which an ink tank (not shown) is, for example, releasably attached and through which ink or the like is fed from the ink tank to the liquid ejection boards 200.

Figure 3:
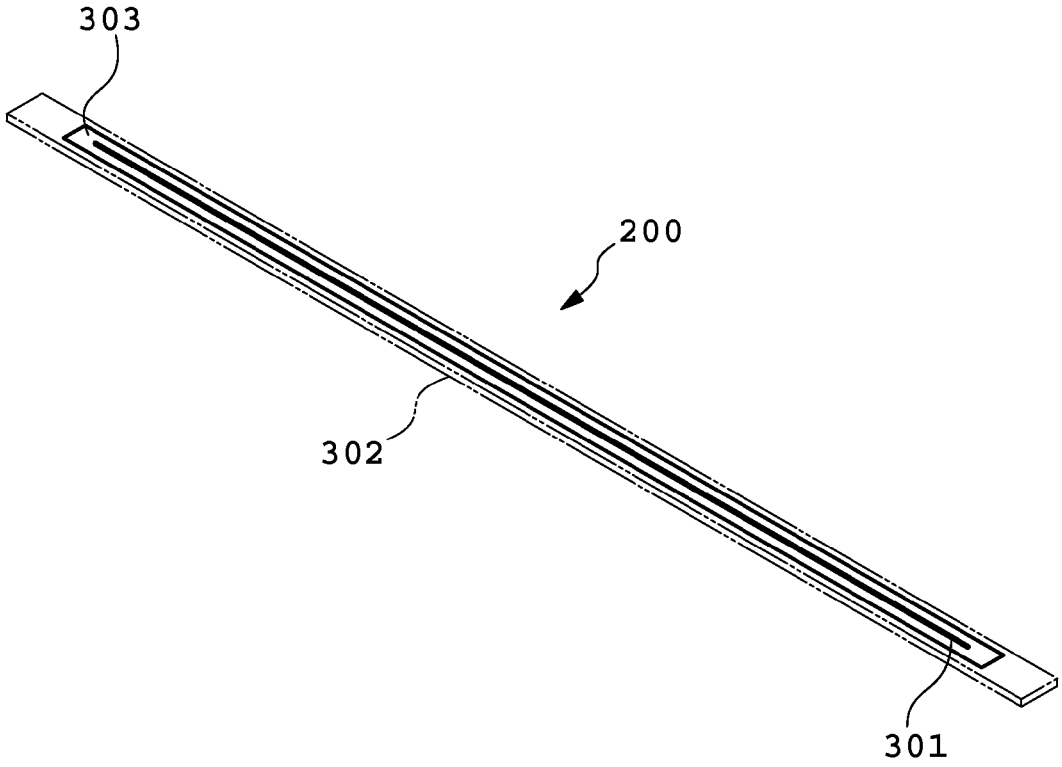
FIG. 3 is a perspective view showing a liquid ejection board used in the first embodiment.
Figure 4:
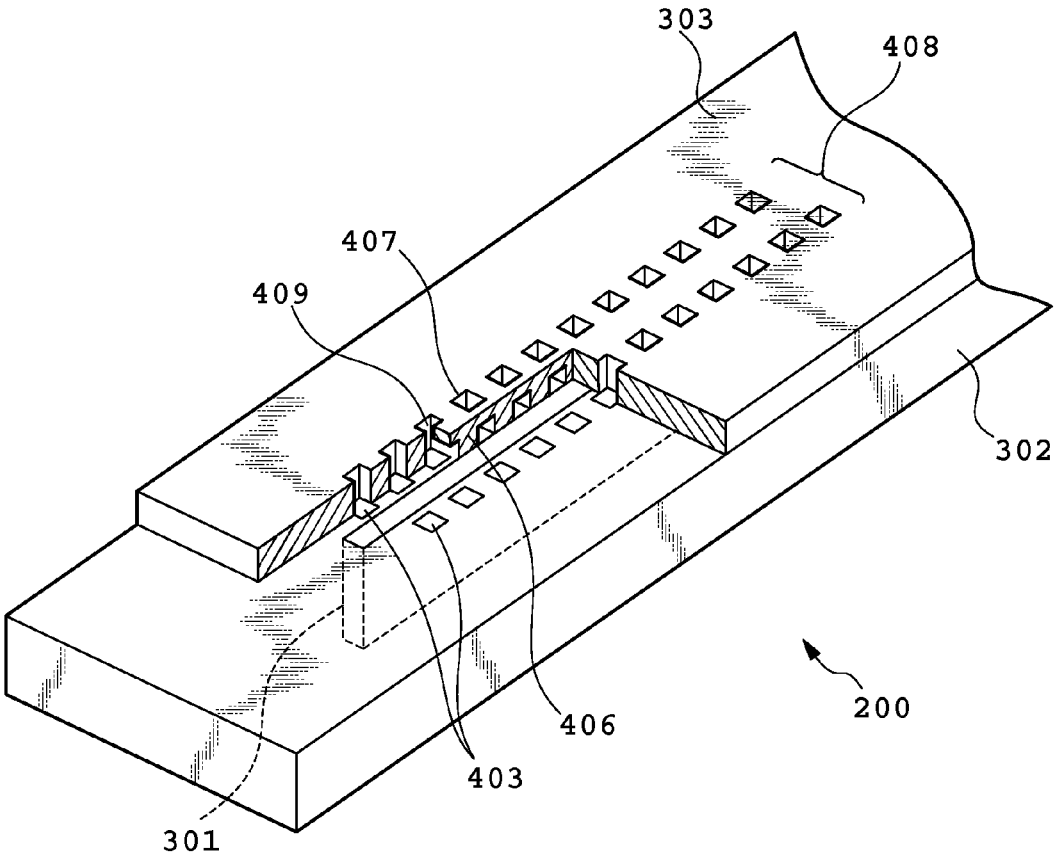
FIG. 4 is an enlarged diagram showing a part of the liquid ejection board.

FIG. 3 is a perspective view showing the liquid ejection board 200 used in the present embodiment. FIG. 4 is a partly enlarged diagram of the liquid ejection board 200. The liquid ejection board 200 is made up of a first member 303 including ejection ports 407 and a second member 302 that supports the first member 303. The first member 303 is a flow path forming member that forms an ink path therein which is communicated with the ejection opening 407 opening on the surface of the first member 303. A liquid supply port 301 is formed in a central part of a Si board (second member) 302 so as to penetrate the Si board 302 from a front surface to a back surface thereof. A plurality of electrothermal transducing elements 403 are arranged on the front surface of the Si board 302 at predetermined positions. In the liquid ejection board 200, bubbling chambers 409 and ejection ports 407 corresponding to the electrothermal transducing elements are formed of a member such as resin. A counter electrode (not shown) is formed on a surface of the liquid ejection board 200, which is opposite a surface thereof having the ejection ports 407, to externally feed power or a print signal to the electrothermal transducing elements 403 on the liquid ejection board 200.

Figure 5A:
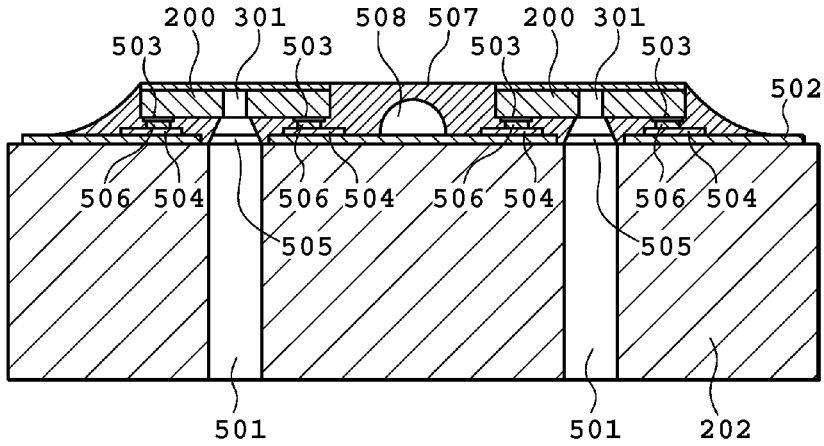
FIG. 5A is a diagram showing a cross section of the print head according to the first embodiment.
Figure 5B:
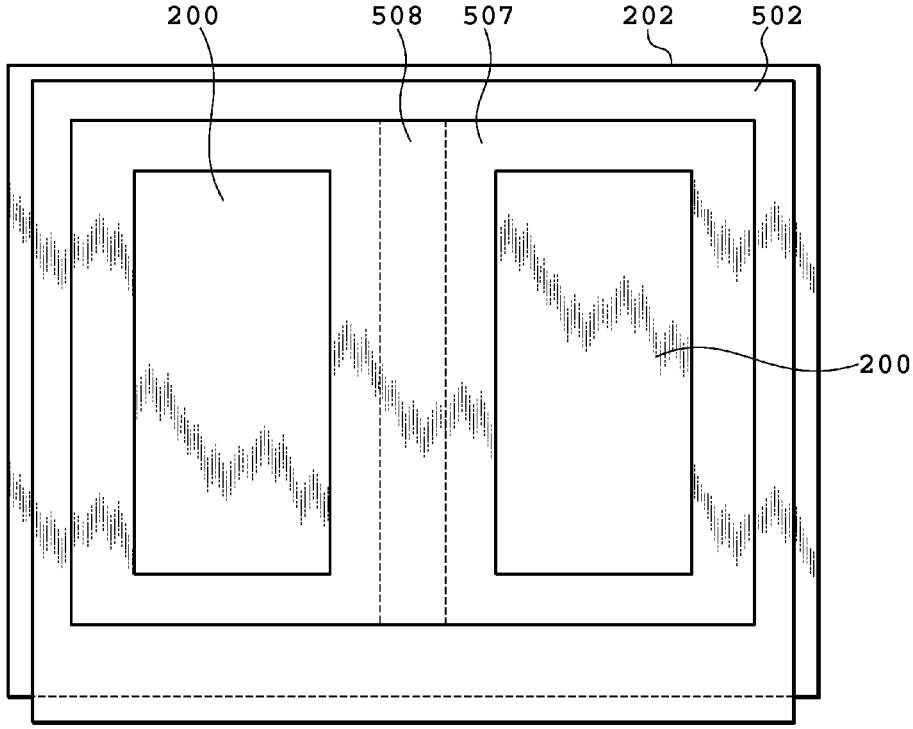
FIG. 5B is a diagram showing a top surface of the print head according to the first embodiment.

FIG. 5A is a sectional view of the ink jet print head 201 according to the present embodiment. FIG. 5B is a top view of the ink jet print head 201.

Liquid supply paths 501 are formed in the support member 202 at predetermined positions so as to penetrate the support member 202 from a back surface to a front surface thereof to supply ink or the like to the liquid ejection board 200. A flexible wiring member 502 transmits external power and electric signals to the liquid ejection board 200. The flexible wiring member 502 has electrode terminals 504 arranged on a front surface thereof at predetermined positions for connection to back electrodes 503 provided on a back surface of the liquid ejection board 200. The flexible wiring member 502 has liquid supply holes 505 formed therein and corresponding to the liquid supply ports 301 in the liquid ejection board 200. The electrode terminals 504 are joined to the respective back electrodes 503 on the liquid ejection board 200 via metal bumps 506. A resin 507 such as an adhesive or a sealant is provided between the adjacent liquid ejection boards 200. In the print head according to the present embodiment, as shown in FIGS. 5A and 5B, a cavity 508 is formed inside the resin 507 between the adjacent liquid ejection boards 200. The cavity 508 has predetermined size. The term "predetermined size" is a size that the entire cavity can exist in the top surface inside of the sealant and a size bigger than an air bubble that was mixed at the time of sealing with the sealant.

The cavity 508 is thus formed inside the resin 507, preventing the formation, between the adjacent liquid ejection boards 200, of a recess in which ink may be collected. Thus, the substantial volume of the resin 507 can be reduced. This prevents ink or the like from being collected in the recess between the liquid ejection boards 200. Furthermore, even if the resin is expanded or contracted by a variation in temperature during a manufacturing process or in the temperature of an environment in which the product is used, the reduced substantial volume of the resin reduces the amount by which the volume varies during the expansion or contraction. This configuration thus enables a reduction in external force exerted on the liquid ejection board 200 as compared to a configuration in which the resin 507 does not contain the cavity 508.

Now, a description will be given of a method for manufacturing the print head 201 having the cavity 508.

Figure 6A:
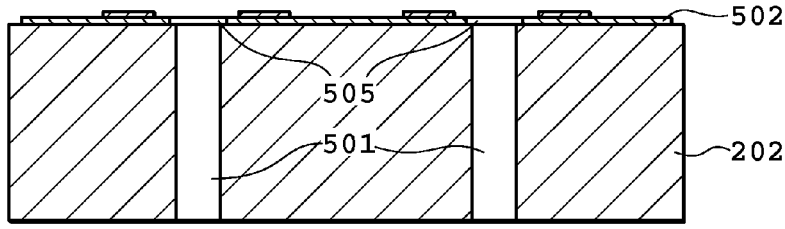
FIG. 6A is a diagram showing a method for manufacturing the print head in FIG. 2.

FIGS. 6A to 6E are diagrams showing the method for manufacturing the print head 201 according to the present embodiment. FIG. 6A shows a first step of manufacturing the print head 201 according to the present embodiment. The flexible wiring member 502 is adhesively fixed on the support member 202 so that the liquid supply paths 501 in the support member 202 are in communication with the respective liquid supply holes 505 in the flexible wiring member 502.

Figure 6B:
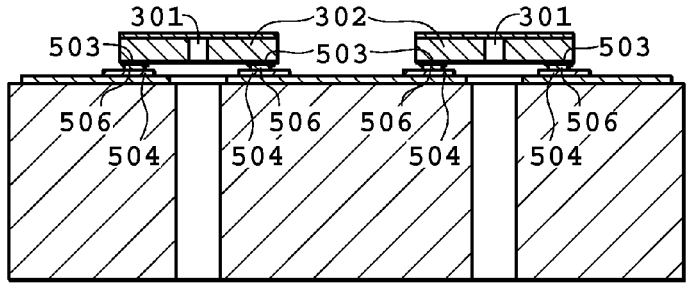
FIG. 6B is a diagram showing the method for manufacturing the print head in FIG. 2.

FIG. 6B shows a step following the one shown in FIG. 6A. The liquid ejection board 200 is placed and positioned on the flexible wiring member 502. The electrode terminals 504 on the flexible wiring member 502 are joined to the respective back electrodes 503 on the liquid ejection board 200 via metal bumps 506 by ultrasonic junction or thermocompression bonding. At this time, the metal bumps 506 may be preformed on the back surface of the liquid ejection board 200 or formed on the respective electrode terminals on the flexible wiring member 502.

Figure 6C:
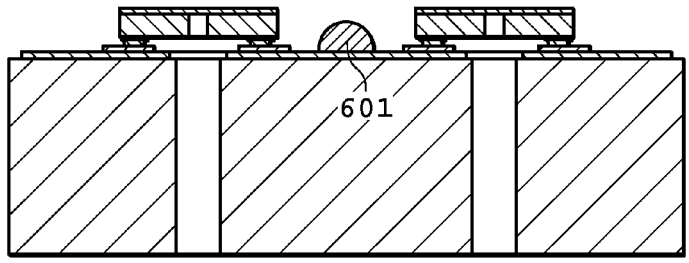
FIG. 6C is a diagram showing the method for manufacturing the print head in FIG. 2.

FIG. 6C is a step following the one shown in FIG. 6B. To form the cavity 508 inside the resin 507 filled between the adjacent liquid ejection boards 200, a predetermined amount of mold material 601 is applied to an area located almost midway between the liquid ejection boards 200 along a longitudinal direction of the liquid ejection board 200 over a length longer than that of the liquid ejection board 200. The mold material 601 is then cured. Since the sectional shape of the mold material 601 corresponds to the sectional shape of the cavity 508, the shape of the mold material 601 is optimized depending on the distance between the liquid ejection boards 200 and the thickness of the liquid ejection board 200. The mold material 601 can be a liquid resin and is applied by a dispenser. However, the mold material 601 may be a resin like a dry film and may be shaped by photolithography. The present invention is not limited to the order of the steps shown in the present embodiment. The step of forming the mold material 601 and the step of applying the resin 507 may be executed before or after the step of placing the liquid ejection board 200. However, if the dry film is used as the mold material 601, a step of applying the dry film or a photolithography step may damage the liquid ejection board 200. Accordingly, in this case, the formation of the mold material 601 is performed before the step of placing the liquid ejection board 200.

Figure 6D:
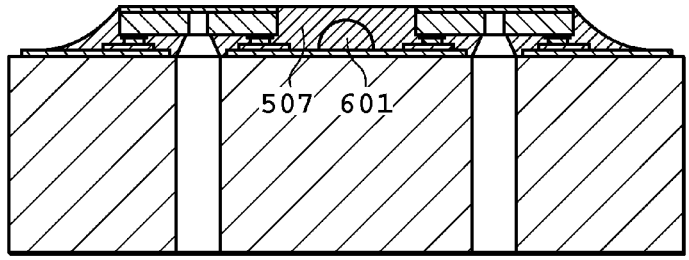
FIG. 6D is a diagram showing the method for manufacturing the print head in FIG. 2.

FIG. 6D shows a step following the one shown in FIG. 6C. The resin 507 is filled between an outer peripheral portion of the liquid ejection board 200 and the adjacent liquid ejection board 200 until a side surface of the Si board 302 is sealed so that the longitudinally opposite ends of the mold material 601 or one of these ends is exposed to the exterior. The resin 507 may be further filled to the surface (the surface of a first member 303) of the liquid ejection board 200 which includes the ejection ports. The step of filling the resin 507 may be executed before the step of placing the liquid ejection board 200. However, since pre-placement of the liquid ejection board 200 allows the amount of resin applied to be more easily adjusted, the filling step can be more easily executed after the placement of the liquid ejection board 200.

Figure 6E:
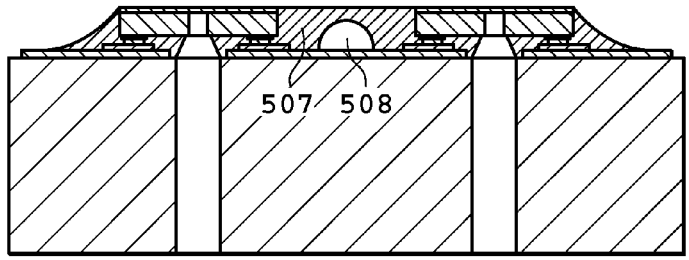
FIG. 6E is a diagram showing the method for manufacturing the print head in FIG. 2.

FIG. 6E shows a step following the one shown in FIG. 6D. A part of the mold material 601 exposed from the resin 507 is melted and removed, using a removing liquid, together with a part of the mold material 601 covered with the resin. The cavity 508 is thus formed inside the resin 507. The mold material 601 is not limited to the resin. Any material other than the resin may be used provided that the material allows a shape to be formed and can be subsequently removed by melting or the like.

In the present embodiment, the cavity 508 is formed between the liquid ejection substrates. However, the present invention is not limited to this. The cavity may be formed in a different area as required.

Figure 7:
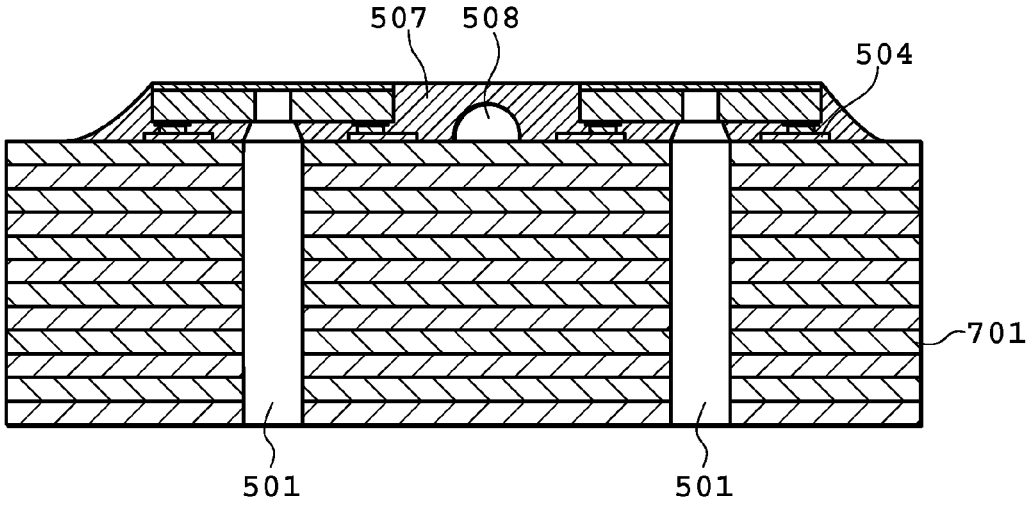
FIG. 7 is a diagram showing a variation of the first embodiment.

FIG. 7 is a diagram showing a variation of the present embodiment. In the present embodiment, the flexible wiring member 502 is located on the front surface of the support member 202. However, as shown in FIG. 7, a stack wiring board 701 integrated with a support member and a wiring member may be used.

In the present embodiment, the electric connection is made by providing the electrodes on the back surface of the liquid ejection board 200. However, the electric connection may be made by providing the electrodes on the front surface of the liquid ejection board 200.

Second Embodiment

Now, a second embodiment of the present invention will be described.

Figure 8:
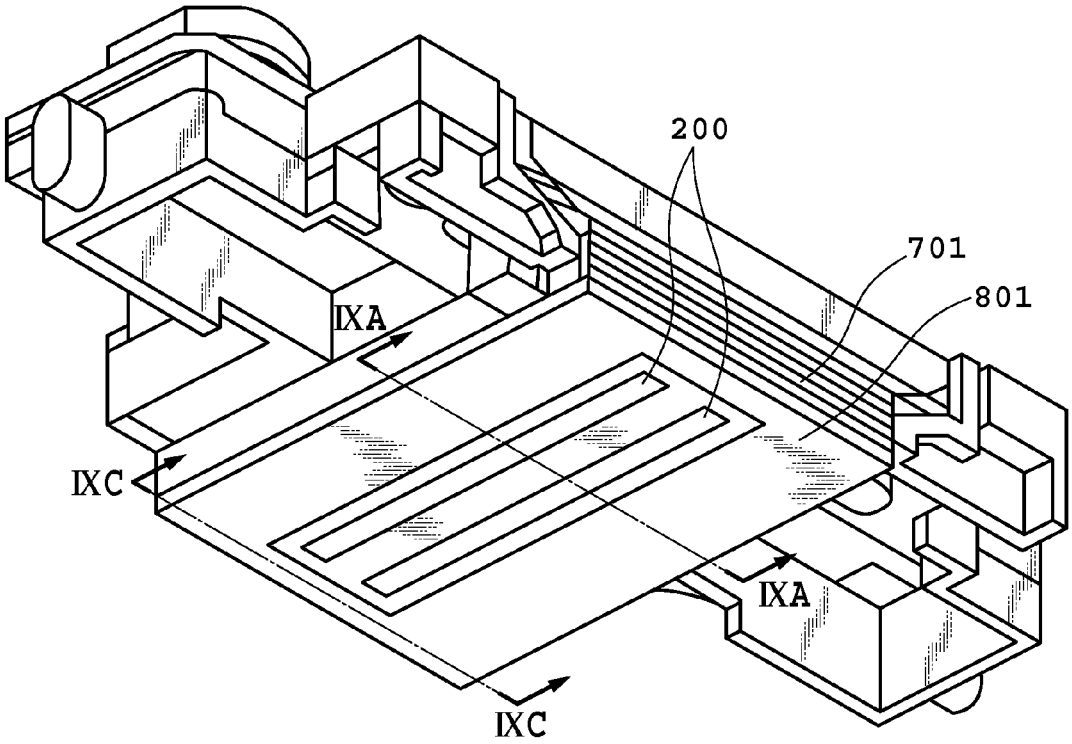
FIG. 8 is a schematic perspective view showing the ink jet print head according to the first embodiment.

FIG. 8 is a schematic perspective view showing an ink jet print head according to the present embodiment. The print head according to the present embodiment does not use the flexible wiring member but uses the wiring board 701 in which an electrode wiring layer and the line are stacked. A plate 801 bonded to the wiring board 701 surrounding the outer periphery of an area in which the liquid ejection boards 200 are arranged. The plate 801 is provided so that that surface of each of the liquid ejection boards 200 which has the ejection ports is located at the same height as that of a top surface of the plate 801.

Figure 9A:
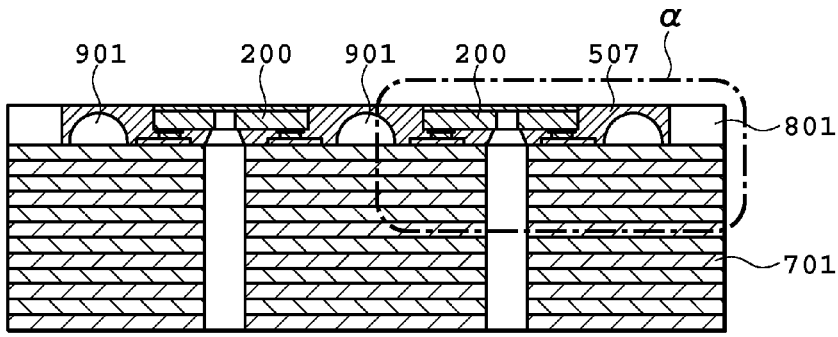
FIG. 9A is a sectional view taken along line IXA-IXA in FIG. 8.
Figure 9B:
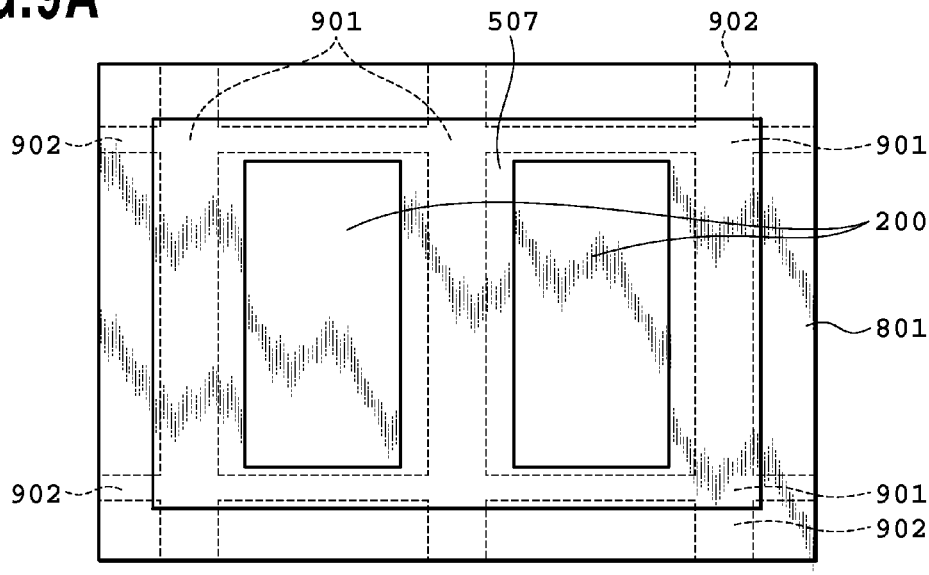
FIG. 9B is a diagram showing how cavities are formed in the print head according to the first embodiment.
Figure 9C:
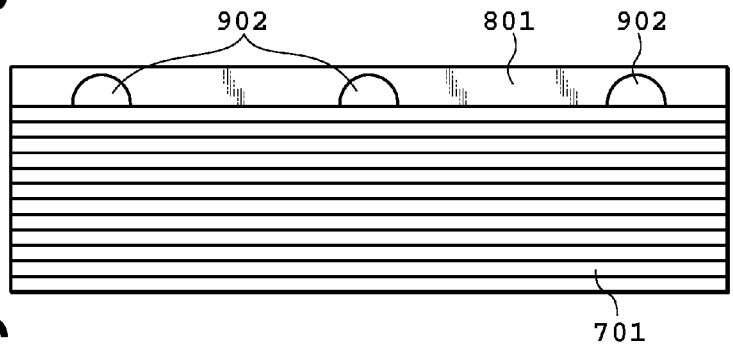
FIG. 9C is a sectional view taken along line IXC-IXC in FIG. 8.
Figure 20:
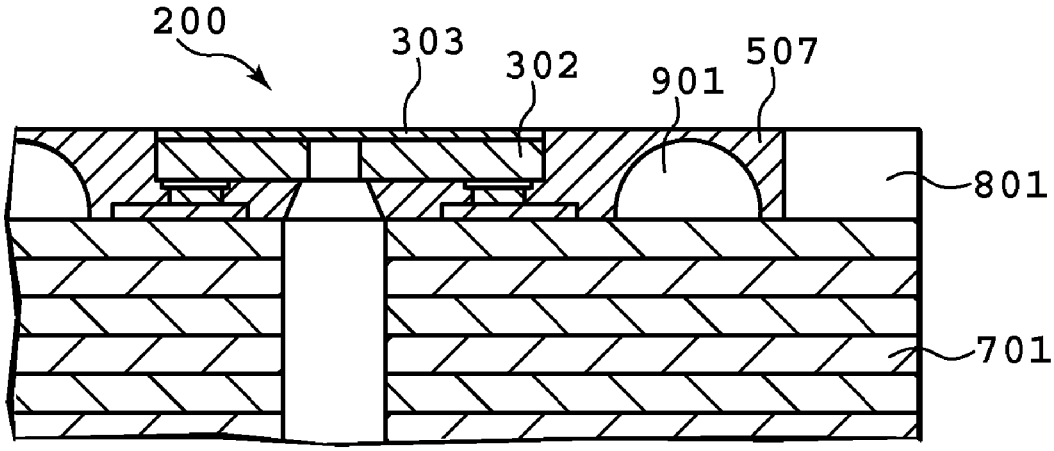
FIG. 20 is an enlarged diagram showing an a portion in FIG. 9A.

FIGS. 9A to 9C are diagrams showing how cavities 901 are formed in the print head according to the present embodiment. FIG. 9A is a sectional view taken along line IXA-IXA in FIG. 8. FIG. 9B is a top view of FIG. 9A, and FIG. 9C is a sectional view taken along line IXC-IXC in FIG. 8. In the present embodiment, the areas between the liquid ejection boards 200 and between the plate 801 and each of the liquid ejection boards 200 are sealed with the resin 507. The resin 507 may be further filled to the surface (the surface of a first member 303) of the liquid ejection board 200 which includes the ejection ports. Additionally, the resin 507 may be filled to the side surface of the Si board 302 in the liquid ejection board 200 as shown in FIG. 20, which is an enlarged diagram of a portion in FIG. 9A. Cavities 901 are formed inside the resin 507 located between the liquid ejection boards 200 and between the plate 801 and the liquid ejection board 200. Grooves 902 corresponding to the respective cavities are formed in the plate 801 so as to be in communication with the respective cavities in the resin 507. The cavities 901 inside the resin 507 are in communication with the exterior. The cavities 901 according to the present embodiment may be formed as is the case with the first embodiment.

The present embodiment can exert effects similar to those of the first embodiment. Furthermore, in the present embodiment, the outer periphery of each of the liquid ejection boards 200 is flattened by the plate 801 and the resin 507, preventing the projection of the liquid ejection board 200. This enables a reduction in damage to the liquid ejection board 200 when a paper jam or the like occurs.

Figure 19:
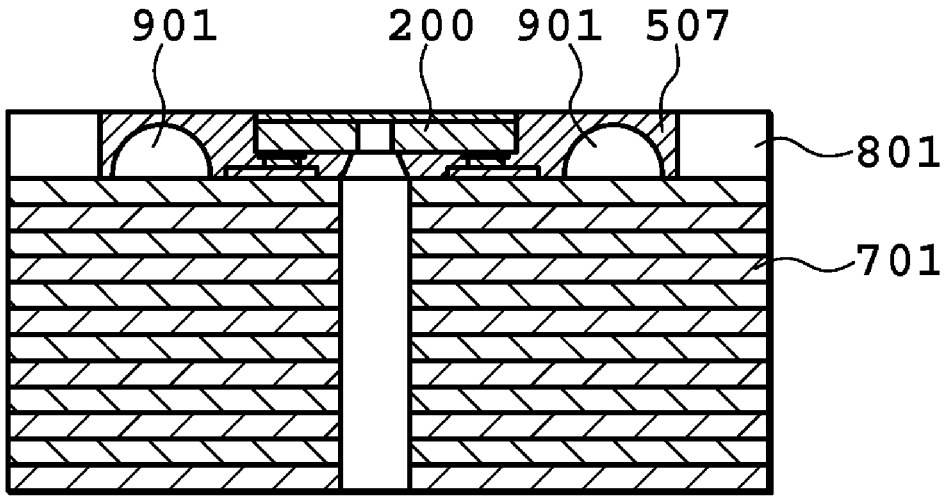
FIG. 19 is a diagram showing a variation of the second embodiment.

Thus, the present embodiment can produce similar effects even for a single liquid ejection board as shown in FIG. 19.

Figure 10:
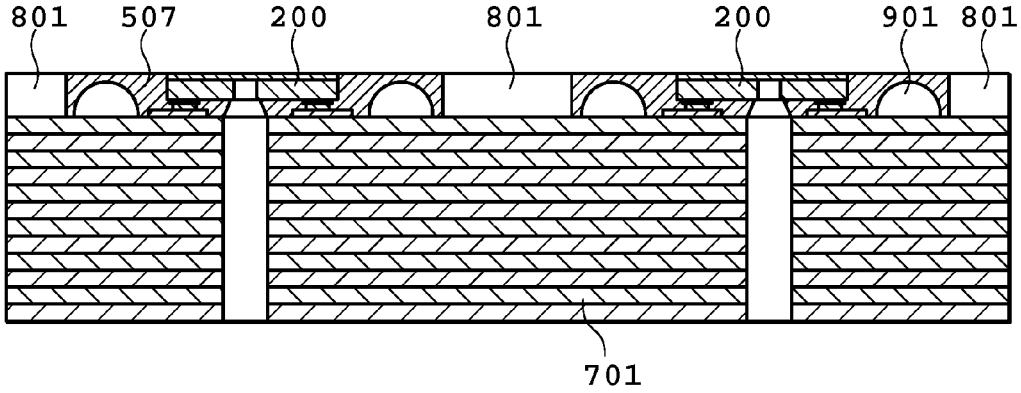
FIG. 10 is a diagram showing a variation of a second embodiment.

FIG. 10 is a diagram showing a variation of the present embodiment.

In the variation shown in FIG. 10, the liquid ejection boards 200 are arranged with the distance between the liquid ejection boards 200 increased so that a part of the plate 801 is interposed between the liquid ejection boards 200. The resin 507 is further filled between each of the liquid ejection boards 200 and the part of the plate 801 located between the liquid ejection boards 200. The cavities 901 are formed inside the resin 507. The configuration shown in FIG. 10 makes it possible to accomplish the object of the present invention.

In the present embodiment, the plate 801 is bonded to the stack wiring board 701. However, the present invention is not limited to this. A stack board integrated with a plate portion may be used. Furthermore, the present embodiment uses the stack wiring board 701 but may use the flexible wiring member similarly to the first embodiment.

Third Embodiment

Now, a third embodiment of the present invention will be described.

Figure 11A:
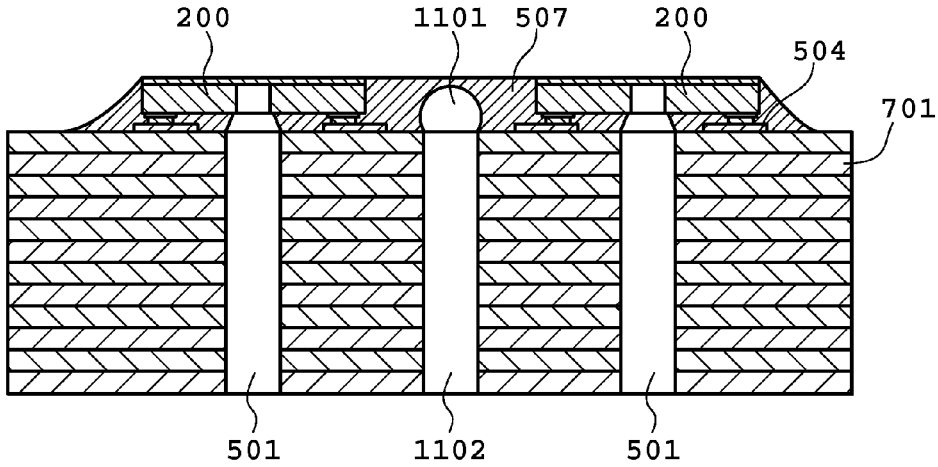
FIG. 11A is a diagram showing a sectional view of an ink jet print head according to the third embodiment.
Figure 11B:
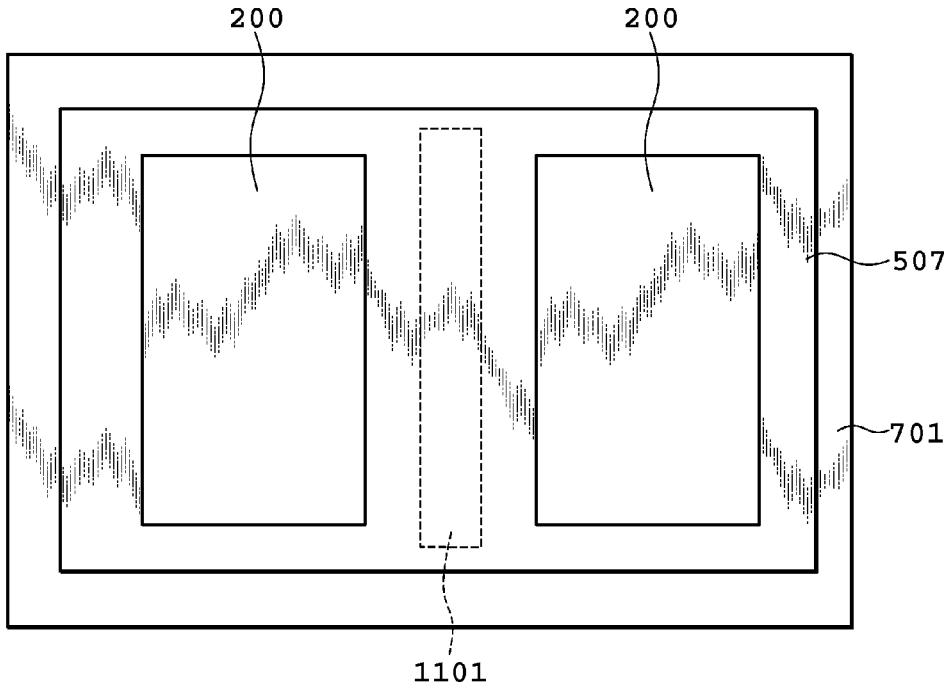
FIG. 11B is a diagram showing a top view of an ink jet print head according to the third embodiment.

FIG. 11A is a sectional view of an ink jet print head according to the present embodiment. FIG. 11B is a top view of the ink jet print head.

As is the case with the second embodiment, the print head according to the present embodiment does not use the flexible wiring member but uses the stack wiring board 701. As is the case with the first and second embodiments, the ink jet print head according to the present embodiment has a cavity 1101 inside the resin 507. However, a method for forming the cavity according to the third embodiment is different from those according to the other embodiments. A through-hole 1102 is formed in a central part of the wiring board 701 so as to join to the cavity 1101. The cavity 1101 is formed using the through-hole 1102.

Description will be given below of a method for manufacturing the print head according to the present embodiment.

FIGS. 12A to 12D are diagrams sequentially showing the steps of manufacturing the print head according to the present embodiment. The manufacturing method will be described below in order of the steps.

Figure 12A:
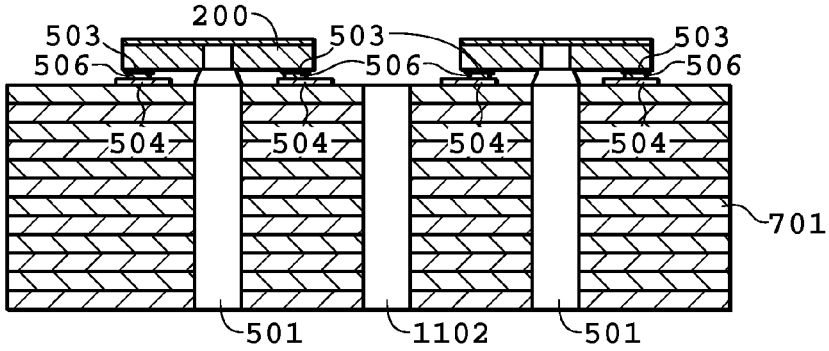
FIG. 12A is one of diagrams sequentially showing a process of manufacturing the print head according to the third embodiment.

In the step shown in FIG. 12A, the liquid ejection boards 200 are placed and positioned on the stack wiring board 701. The back electrodes 503 on the liquid ejection board 200 are joined to the respective electrode terminals 504 on the stack wiring board 701 via the respective metal bumps 506.

Figure 12B:
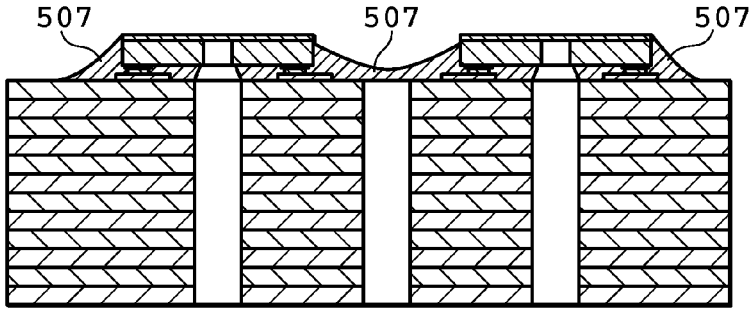
FIG. 12B is one of the diagrams sequentially showing the process of manufacturing the print head according to the third embodiment.

In the step shown in FIG. 12B, a dispenser or the like is used to apply an appropriate amount of resin 507 between the liquid ejection boards 200 and to the outer periphery of each of the liquid ejection boards 200. At this time, when the resin 507 is applied between the liquid ejection boards 200, the application is performed so as to cover the through-hole 1102, with a top surface of the resin recessed as shown in FIG. 12B. Since the resin 507 may flow into the through-hole 1102 depending on the viscosity of the resin 507, the opening of the through-hole 1102 has a size appropriate to prevent the resin 507 from flowing into the through-hole 1102.

Figure 12C:
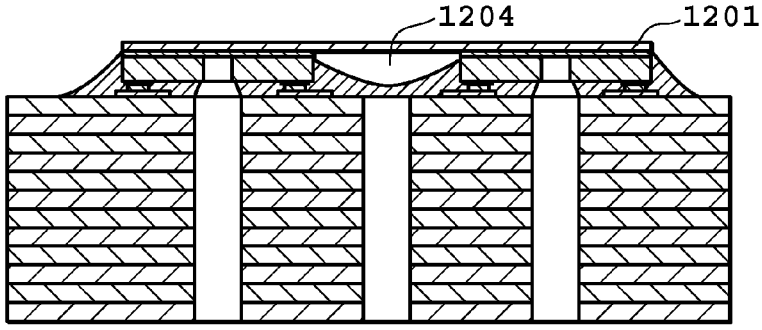
FIG. 12C is one of the diagrams sequentially showing the process of manufacturing the print head according to the third embodiment.

In the step shown in FIG. 12C, a sheet 1201 that allows gas to pass through while preventing liquid from passing through is installed so that the applied portion is covered with both the liquid ejection boards 200 and the resin 507 located between the liquid ejection boards 200.

Figure 12D:
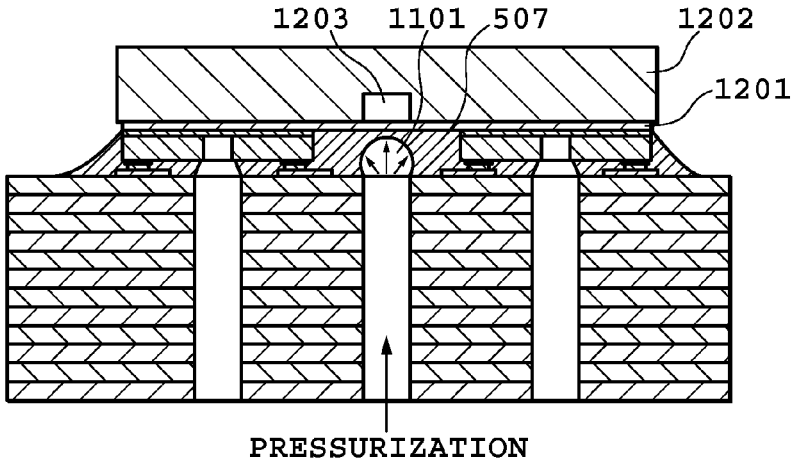
FIG. 12D is one of the diagrams sequentially showing the process of manufacturing the print head according to the third embodiment.

In the step shown in FIG. 12D, the sheet 1201 being heated with a heating tool 1202 is pressed against the liquid ejection board 200 so as to come into tight contact with the liquid ejection board 200. Air is introduced through the through-hole 1102 in the stack wiring board 701 to exert pressure on the resin 507. The pressure pushes the resin 507 upward, and at the same time, the air in a space 1204 formed between the sheet 1201 and the resin 507 passes through the sheet 1201 and is emitted through a clearance groove 1203 in the heating tool 1202.

Figure 13:
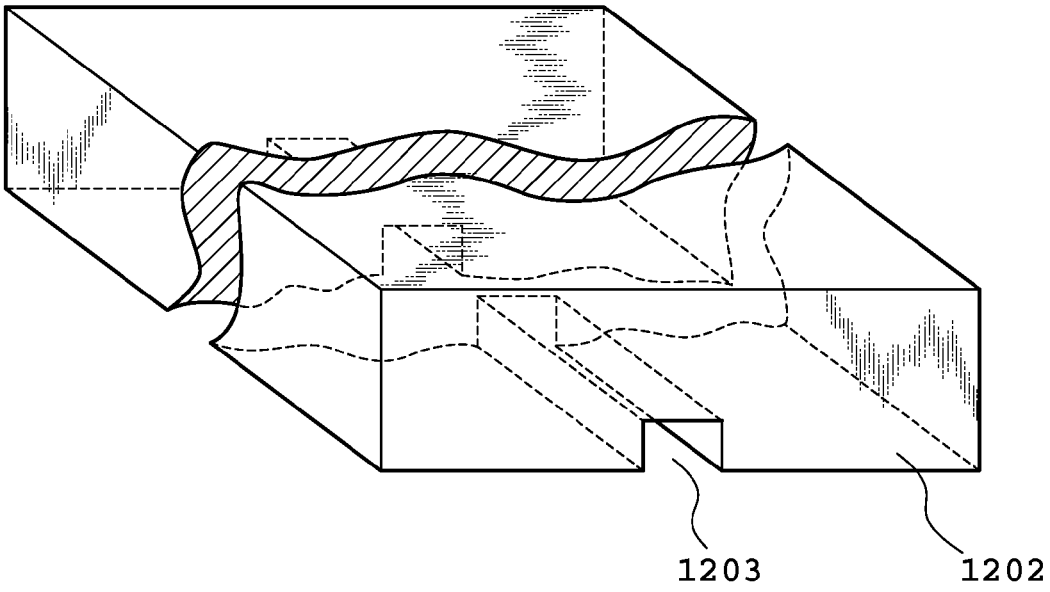
FIG. 13 is a diagram showing a heating tool.

FIG. 13 is a diagram showing the heating tool 1202. As shown in FIG. 13, the clearance groove 1203 allows the air in the space 1204 to escape to the exterior. The escape of the air in the space 1204 to the exterior causes the resin 507 between the liquid ejection boards 200 to be pressed against the sheet

1201. In this condition, the heating with the heating tool 1202 is continued to the degree that the resin 507 can hold its own shape. The thus formed resin 507 internally has the cavity 1101 of a predetermined size and has a top surface flush with the surface of the liquid ejection board 200 which has the ejection ports. Once the resin 507 is completely cured, the heating tool 1202 and the sheet 1201 are removed. The print head according to the present embodiment is thus completed.

Instead of the above-described method for heating the resin with the heating tool 1202, a method may be used which cures the photoreactive resin 507 by means of ultraviolet rays or the like. In this case, the sheet 1201 may be light-transmissive.

In the present embodiment, the method has been shown which forms the cavity 1101 by pressurization with air supplied through the through-hole 1102. However, the method described in the first embodiment may be used instead, which uses the mold material to form the cavity 1101 and then removes the mold material through the through-hole 1102.

Figure 14:
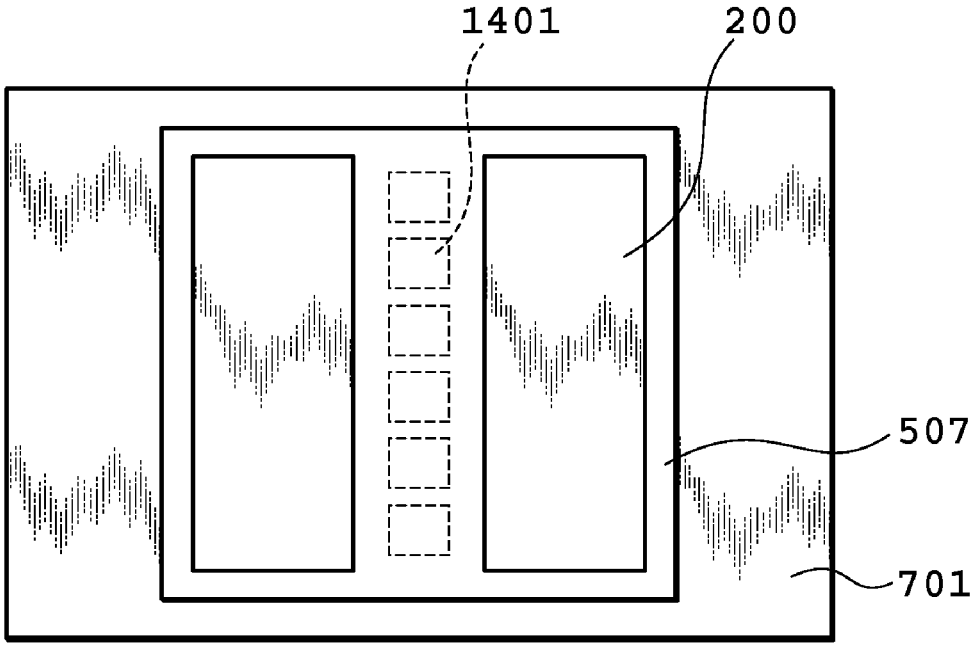
FIG. 14 is a diagram showing a variation of the third embodiment.
Figure 15A:
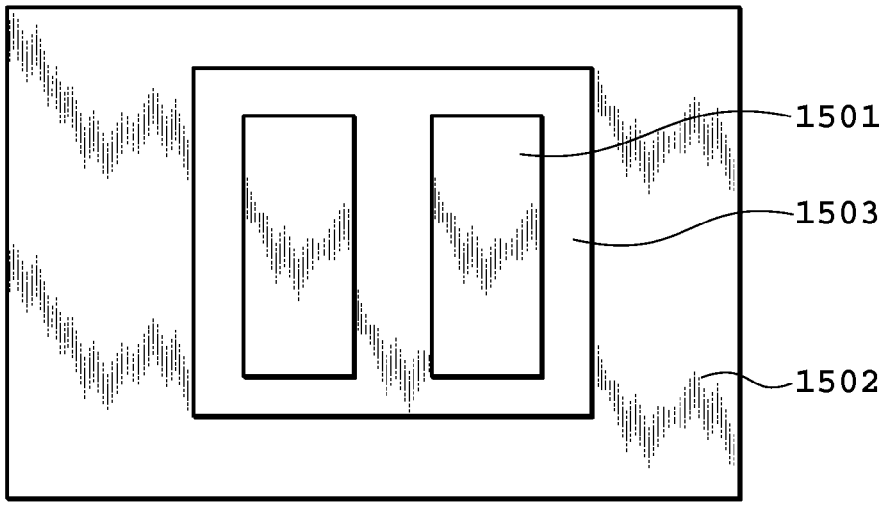
FIG. 15A is a schematic top view showing a conventional ink jet print head.
Figure 15B:
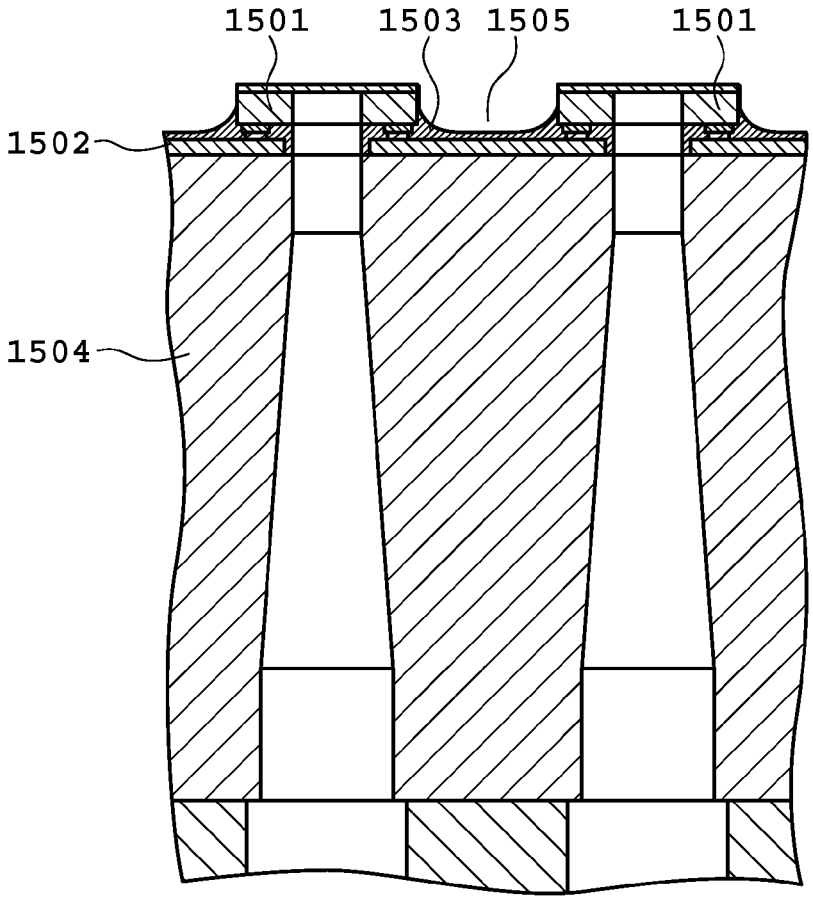
FIG. 15B is a partial sectional view showing a part of a side surface of the conventional ink jet print head.
Figure 16:
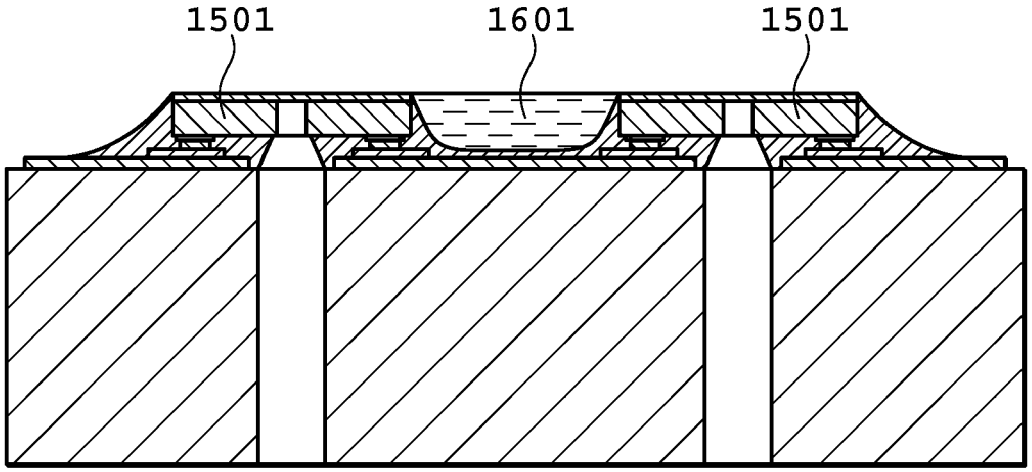
FIG. 16 is a diagram showing that ink has been collected in a recessed portion between liquid ejection boards in the conventional print head.
Figure 17:
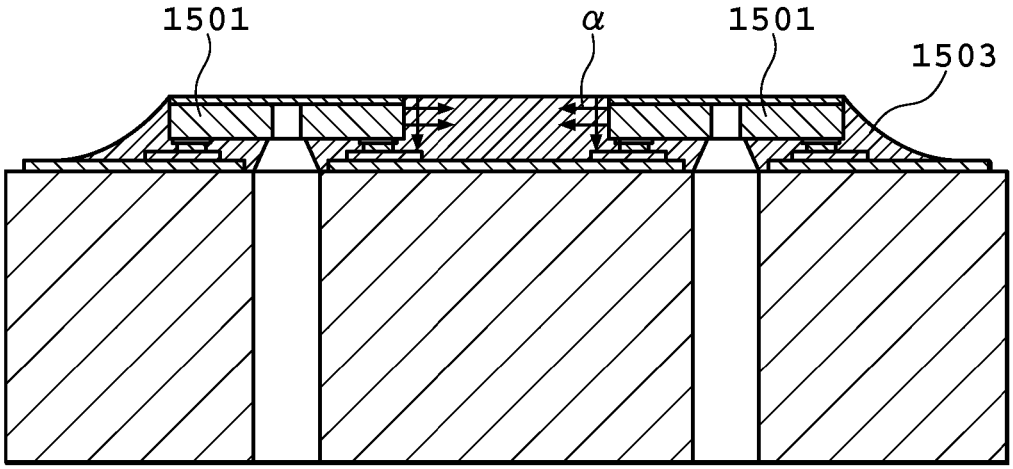
FIG. 17 is a diagram showing that an internal stress has been generated by a sealant in the conventional print head.
Figure 18:
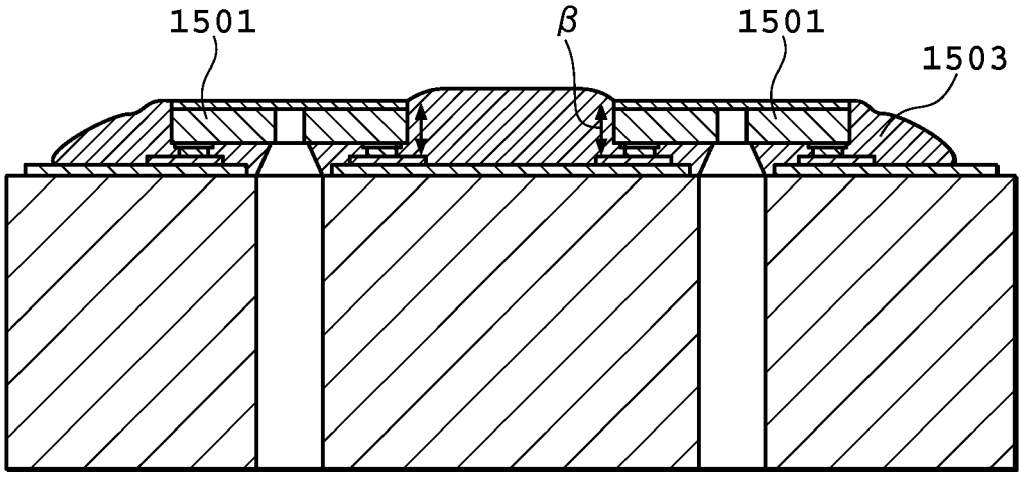
FIG. 18 is a diagram showing that an internal stress has been generated by the sealant in the conventional print head.

Moreover, the present embodiment eliminates the need to expose mold material from the resin 507, making it possible to make the cavity 1101 shorter than the liquid ejection board 200. Furthermore, as shown in FIG. 14, the through-holes 1401 may be arranged at intervals to form the cavities at the corresponding intervals. When the shorter cavities are formed or the cavities are formed at the intervals as described above, a large number of walls of the resin 507 are formed around the periphery of each of the cavities and inside the cavity. This is effective for ensuring the strength of the resin 507 to prevent problems such as damage to the resin 507 caused by an external impact. In this case, appropriately setting the volume of the cavity also makes it possible to exert the effects of the cavity which meet the object of the present invention.

The configuration of the present embodiment uses the stack wiring board 701. However, instead, a support member and a flexible wiring member may be stuck together as a wiring board. However, particularly when liquid supply ports are formed at small pitches, the stack wiring board, in which the stacked layers may be processed to have any different shapes, has a higher degree of freedom than the combination of the support member and the flexible wiring board in terms of the shape and position of the through-hole. The stack wiring board is thus preferable for the present configuration.

Furthermore, the step of applying the resin 507 may be executed before the step of arranging the liquid ejection boards 200. However, the ejection port surface of the liquid ejection board 200 can be set at the same height as that of the resin 507 when the step of applying the resin 507 is executed after the step of arranging the liquid ejection boards 200.

Any appropriate system may be used to eject ink; the ink may be ejected by, for example, using an electromechanical converter such as a piezo element or using an eletrothermal converter such as a heating resistor to heat the ink to cause film boiling.

The configuration of the print head according to the present embodiment uses the two liquid ejection boards. However, the present invention is not limited to this. The print head may use a single liquid ejection board or two or more liquid ejection boards.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2007-097714, filed Apr. 3, 2007 and 2008-074020, filed Mar. 21, 2008 which are hereby incorporated by reference herein in their entirety.

What is claimed is:

1. An ink jet print head comprising:

a plurality of liquid ejection boards each having an ejection port from which ink is ejected, each of the liquid ejection boards comprising a first member having a surface where the ejection port is opened therein and a second member supporting the first member;

an energy generation element to generate energy used to eject a liquid; and a sealant arranged between the liquid ejection boards, wherein a cavity is formed inside the sealant.

2. The ink jet print head according to claim 1, further comprising a plate surrounding the liquid ejection boards, wherein the sealant, sealing a side surface of the second member, forms a top surface flushed with the surface of the first member including the ejection port.

3. The ink jet print head according to claim 1, further comprising a plate having a surface located at the same height of the surface with the liquid ejection ports of the liquid election boards, wherein an area between the liquid ejection boards and the plate is sealed with the sealant, and wherein a cavity is formed inside the sealant in the area between the liquid ejection boards and the plate.

4. A method for manufacturing an ink jet print head, the method comprising:

preparing a plurality of liquid ejection boards using a first member having a surface which is provided with the ejection port and a second member supporting the first member, an energy generation element to generate energy used to eject a liquid, the liquid ejection boards arranged on a support member, a sealant sealing between the plural liquid ejection boards; and forming a cavity of a preset size inside the sealant.

5. The method for manufacturing an ink jet print head according to claim 4, further comprising introducing the sealant to form a surface which is aligned with the surface of the first member which is provided with the ejection port.

6. The method for manufacturing the ink jet print head according to claim 4, wherein the step of forming the cavity includes placing a mold material in an area where the cavity is to be formed and removing the mold material after the sealant has been placed.

7. The method for manufacturing the ink jet print head according to claim 4, wherein the step of forming the cavity includes:

placing the sealant and then introducing external air into the area where the cavity is to be formed, to form the cavity; and forming a surface of the sealant which is aligned with a surface of the liquid ejection board which includes the ejection port.

8. The method for manufacturing the ink jet print head according to claim 7, wherein a member supporting the liquid ejection board has a through-hole through which the air is introduced.

9. An ink jet printing apparatus having the ink jet print head according to claim 1.

* * * * *